US007198351B2

(12) United States Patent
Wang et al.

(10) Patent No.: US 7,198,351 B2
(45) Date of Patent: Apr. 3, 2007

(54) INK JET RECORDING APPARATUS

(75) Inventors: Bing Wang, Nagoya (JP); Hirotake Nakamura, Nagoya (JP); Masayuki Arakawa, Nagoya (JP)

(73) Assignee: Brother Kogyo Kabushiki Kaisha, Nagoya-Shi, Aichi (JP)

( * ) Notice: Subject to any disclaimer, the term of this patent is extended or adjusted under 35 U.S.C. 154(b) by 144 days.

(21) Appl. No.: 10/661,275

(22) Filed: Sep. 12, 2003

(65) Prior Publication Data

US 2004/0056918 A1 Mar. 25, 2004

(30) Foreign Application Priority Data

Sep. 24, 2002 (JP) ..... 2002-277258
Sep. 27, 2002 (JP) ..... 2002-283935
Sep. 30, 2002 (JP) ..... 2002-285153
Sep. 30, 2002 (JP) ..... 2002-285158

(51) Int. Cl.
*B41J 2/165* (2006.01)
*B41J 2/175* (2006.01)

(52) U.S. Cl. ..... 347/28; 347/86

(58) Field of Classification Search ..... 347/40, 347/85, 86, 93, 84, 100
See application file for complete search history.

(56) References Cited

U.S. PATENT DOCUMENTS 3,856,711 A * 12/1974 Mausner et al. ..... 510/413
4,356,499 A * 10/1982 Kodama ..... 347/40
4,849,769 A 7/1989 Dressler
5,124,717 A 6/1992 Campanelli et al.
5,495,272 A * 2/1996 Yamaguchi ..... 347/28
5,619,237 A * 4/1997 Inoue et al. ..... 347/86
6,062,390 A 5/2000 Nakamura
6,199,979 B1 * 3/2001 Hobson et al. ..... 347/93

(Continued)

FOREIGN PATENT DOCUMENTS

EP 0 887 190 A2 12/1998

(Continued)

OTHER PUBLICATIONS

RD 194011A, Jun. 1980.*

(Continued)

*Primary Examiner*—Shih-Wen Hsieh
(74) *Attorney, Agent, or Firm*—Day Pitney LLP

(57) ABSTRACT

A head unit is inverted so that an outflow port is in the lowest position. Because the top wall of the buffer tank slopes downwards towards the outflow port, all remaining cleaning fluid that was introduced during manufacture is removed. Also, a notch is provided in the bottom end of an ink introduction port. The notch faces towards the outflow port so that bubbles in the ink exit from the notch and are guided towards the outflow port. The head unit is shipped while the buffer tank is filled with preservation fluid that has high wettability and any openings to the outside air are closed off with covers. When the head unit is used, the preservation fluid is sucked by a purging device and then ink, which has a high affinity for the preservation fluid, is smoothly introduced. Also, the inner surface of the filters are treated to increase the wettability by ink after the filters are fixed to the bottom lid. Afterwards the bottom lid is fixed to the top lid to form the buffer tank.

17 Claims, 7 Drawing Sheets

U.S. PATENT DOCUMENTS

| | | | | |
|---|---|---|---|---|
| 6,231,174 | B1 | 5/2001 | Haigo | |
| 6,257,712 | B1 | 7/2001 | Haigo | |
| 6,338,539 | B1 * | 1/2002 | Kobayashi et al. | 347/23 |
| 6,338,554 | B1 * | 1/2002 | Kitahara | 347/93 |

FOREIGN PATENT DOCUMENTS

| | | |
|---|---|---|
| EP | 0 945 272 A2 | 3/1999 |
| JP | 9 193380 | 7/1997 |
| JP | 9-296368 | 11/1997 |
| JP | 10 272784 | 10/1998 |
| JP | 10 272786 | 10/1998 |
| JP | 10 315503 | 12/1998 |
| JP | 111046 | 1/1999 |
| JP | 11198393 | 7/1999 |
| JP | 2000 33714 | 2/2000 |
| JP | 2001 260388 | 9/2001 |
| WO | WO 98/31547 | 7/1998 |

OTHER PUBLICATIONS

Partial European search Report listing references.

* cited by examiner

INK JET RECORDING APPARATUS

BACKGROUND OF THE INVENTION

1. Field of the Invention

The present invention relates to an ink jet recording apparatus. In detail, the ink jet recording apparatus comprises a buffer tank, a mechanism for removing bubbles, and a head unit. The buffer tank contains ink to be supplied to the ink jet head. The mechanism for removing bubbles removes bubbles mixed into the ink, and is located between the buffer tank and the ink supply source.

2. Description of Related Art

Ink jet recording apparatuses that eject ink onto a recording medium based upon input signals have been known and extensively used in the art. One type is an ink jet recording apparatus in which ink from the ink source is delivered to an ink jet head through a buffer tank. The ink is directed to a plurality of ink channels in the ink jet head, and ink is ejected from nozzles in the tip of the ink channels by activation of an actuator such as a heat-generating device or a piezoelectric device. For example, as shown in Japanese Patent Application Publication NO.2001-260388, ink is supplied from the ink source to the buffer tank through a tube. Bubbles mixed in the ink are separated from the ink in the buffer tank, and ink is then supplied to the ink jet head. Furthermore, bubbles accumulated in the buffer tank are expelled to either a waste ink tank or they are returned together with ink to the ink source.

There are several methods of supplying ink to the ink jet head. One method consists of installing a cartridge containing ink on the ink jet head and supplying ink to the ink jet head from the ink cartridge. Another method involves connecting an ink tank to a buffer tank through a tube. Ink is supplied from the ink tank through the buffer tank. In this case, the tube connecting the ink tank and the buffer tank is normally a flexible resin tube. Air can permeate through the walls of this tube, and mix with the ink flowing within the tube, and form bubbles.

According to Japanese Patent Application Publication NO.2001-260388, ink is supplied from a sub-tank to the buffer tank through an ink introduction port that is formed in the top wall of the buffer tank and that projects downward into the buffer tank. Ink is introduced into the buffer tank from the lower end of the ink introduction port. The ink meanders through baffle walls so that the bubbles separate from the ink. Ink is supplied to the ink jet head through an ink outlet formed in the bottom of the buffer tank. Bubbles accumulate near the ceiling of the buffer tank, and at suitable time intervals they are removed through an outflow port by activating a pump. Also, in Japanese Patent Application Publication No. H10-315503, air buffers are provided in both the path from the sub-tank to the ink jet head and the return path from the ink jet head to the sub-tank. When following the path to the ink jet head, ink flows into the top and out through the bottom of the air buffer towards the ink jet head. Also, when following the return path, ink flows into the bottom and out through the top of the air buffer towards the sub-tank.

Also, normally ink drops are ejected from an ink jet head which has been supplied with ink from the ink cartridge installed on the head unit to which the ink jet head is fixed. However, the ink cartridge is not installed on the head unit when carrying out printing, that will consume a large quantity of ink. Rather an ink jet recording apparatus that is capable of using a large volume ink cartridge is used.

For example, U.S. Pat. No. 6,231,174 describes an ink jet recording apparatus including of a manifold that supplies and distributes ink to the ink channels on the ink jet head. Also, an ink cartridge (ink tank) is provided separated from the head unit. The manifold and the ink cartridge are connected with a flexible tube, and ink is forced to circulate between them. In this type of ink jet recording apparatus, air that permeates through the walls of the tube mixes with the ink and forms bubbles. These bubbles are introduced into the ink channels through the manifold, and cause defective ejecting. The buffer tank in the ink jet recording apparatus of Japanese Patent Application Publication NO. 2001-260388 is connected to the manifold to prevent bubbles from getting into the manifold. That is, ink is supplied from the ink tank to the ink jet head through the buffer tank and the bubbles accumulate in the buffer tank.

This type of ink jet recording apparatus is shipped from the factory with the head unit separate from the main body, or the head unit is shipped separately as a replacement item. Therefore, in order to smoothly introduce ink into the head unit the first time the head unit is installed, the head unit is filled with preservation fluid, sealed and shipped, as described in U.S. Pat. No. 6,062,390 for example.

An example of this type of ink jet recording apparatus is described in Japanese Patent Application Publication No. 2001-260388. In this ink jet recording apparatus, the ink cartridge is provided independent from the head unit. Ink is supplied from the cartridge to the buffer tank through a flexible tube, and from the buffer tank to the manifold. Ink from the manifold is supplied and distributed to all the ink channels in the ink jet head. In this type of ink jet recording apparatus, a filter is provided in order to prevent bubbles or foreign matter mixed in the ink from entering the manifold when ink is supplied from the buffer tank to the manifold.

On the other hand, Japanese Patent Application Publication No. H9-193380 describes providing an ozone treatment to the internal surface of only the manifold. The ozone treatment improves the hydrophilic nature of the internal surface so that good flow of ink to the ink jet head can be achieved.

SUMMARY OF THE INVENTION

The inventor considered supplying cleaning fluid into the buffer tank under pressure after the buffer tank is connected to the ink jet head, in an attempt to remove impurities that entered during the manufacturing process. However, it was realized that a small amount of cleaning fluid would be forced into the corner of the buffer tank by the movement of the pressurized air, and remain there. Furthermore, this remaining cleaning fluid would flow into the manifold or the ink jet head due to vibrations during transport, and would create bubbles or form a film within the narrow flow channels. Subsequently, the bubbles or film of cleaning fluid would block the ink channel of the ink jet head when the ink jet head was newly filled with ink to start recording operations, and this would result in a loss of a "dot".

It is desirable that a method or configuration that thoroughly removes cleaning fluid after cleaning operations so the ink jet head will not be blocked by the remaining cleaning fluid during recording operations.

Also, in the configuration shown in Japanese Patent Application Publication No. 2001-260388, the ink introduction port that extends from the ceiling of the buffer tank has a flat bottom end that is parallel with the bottom of the buffer tank. Therefore, bubbles entering the buffer tank with the ink will flow in an arbitrary horizontally direction from the opening in the ink introduction port. Because of this, bubbles that leave the ink introduction port and flow towards the outflow port accumulate in the vicinity of the outflow port, and can be removed through the outflow port by operating a pump as needed. However, some of the bubbles that exit the ink introduction port and flow in the opposite direction away from the outflow port can accumulate in a corner at the ceiling of the buffer tank. Bubbles accumulate in the corner cannot be removed by operating of the pump through the outflow port, and they remain there.

A well-known suction purge is carried out to remove fine bubbles and viscous ink from the ink jet head or to fill the ink jet head with ink. However, during the suction purge the bubbles accumulated in the above-described corner are drawn into the ink jet head together with the ink in the buffer tank, and block the nozzles of the ink jet head.

In the configuration shown in Japanese Patent Application Publication No. H10-315503, the open end of the return path from the ink jet head to the air buffer is slanted, so that reverse flow of bubbles back to the ink jet head is prevented. However, this configuration does not prevent bubbles from accumulating in the corner due to flow from the ink introduction port in the opposite direction to the outflow port as described above, and does not prevent bubbles from being drawn into the ink jet head by the operation of the suction purge in the ink jet head.

It is desirable that the buffer tank be free of bubbles even if a bubble removing operation is performed that removes bubbles from the buffer tank with flow of ink.

Also, in the apparatus described in U.S. Pat. No. 6,231,174, when ink jet heads are shipped while filled with preservation fluid, this preservation fluid can leak due to changes in temperature and pressure, and wet the openings in the ejection nozzles. In this condition, when the ink jet head is unpacked and inserted into the main body of the recording apparatus with the openings facing downwards, the preservation fluid that had wet the openings of the ejection nozzles draws the preservation fluid stored within the nozzles downward by the force of surface tension, and stains the inside of the main body of the recording apparatus.

It is desirable that a head unit with the buffer tank filled with preservation fluid be capable of, when the ink jet recording apparatus is used for the first time, introducing the preservation fluid into the ink jet head and then ink with a smooth transition.

In the aforementioned configuration of Japanese Patent Application Publication No. 2001-260388, the filter has poor wettability. In other words, the filter has poor hydrophilicity towards the ink in the buffer tank and when ink passes through the filter, bubbles that have separated out from the ink become attached to the surface or the interior of the filter. Other bubbles combine with the first bubble as a nucleus, and the combination grows to form a cluster of bubbles that clog the filter.

The inventor considered processing the filter to improve the hydrophilicity, for example by plasma processing. However, the filter has a diameter of only about 1 cm, so the filter might disintegrate under the energy of the plasma processing. Also, unless the filter is carefully managed, then which side was subjected to plasma processing could be forgotten. In this case, the filter might be inserted into the buffer tank during subsequent manufacturing operations with the side that had not been subjected to plasma processing facing in the wrong direction.

It is desirable that bubbles be prevented from clinging to the filter so that ink could effectively flow from the buffer tank to the ink jet head and that plasma processing of the filters can be carried out on the inside of the filter with certainty.

A method according to a first aspect of the present invention is for cleaning a head unit that includes an ink jet head, a buffer tank, and a manifold. The ink jet head has a plurality of ink channels and ejects ink while the head unit in a printing posture. The buffer tank stores ink to be supplied to the ink jet head. The buffer tank has a top wall formed with a first port and a second port. The manifold is disposed between and connected to the ink jet head and the buffer tank. The manifold distributes ink from the buffer tank to the plurality of ink channels in the ink jet head.

The method according to the first aspect includes introducing cleaning fluid into the buffer tank through the first port to remove foreign matter from the head unit through the second port. Then, the head unit is turned upside down with respect to the printing posture so that the second port is located in a lowermost position and the top wall slants down toward the second port. Then, the cleaning fluid remaining in the head unit is removed through the second port.

A method according to a second aspect of the present invention is for introducing ink into an unused head unit including a buffer tank and an ink jet head. The buffer tank is for storing ink. The buffer tank has an ink outlet and an ink supply path. The ink supply path is for connecting to an ink supply source. The ink jet head has a plurality of ejection nozzles through which ink supplied from the ink outlet is ejected onto a recording medium.

The method according to the second aspect includes maintaining the buffer tank filled with a preservation fluid before the head unit is used, then introducing the preservation fluid from the buffer tank into the ink jet head before introducing ink into the head unit. Then, the preservation fluid is expelled from the ink jet head. Then, ink from the ink supply source is introduced into the ink jet head through the buffer tank.

A method according to a third aspect of the present invention is for manufacturing a buffer tank for an ink jet recording apparatus. The buffer tank is for holding ink that is supplied from an ink supply source through a supply path and for supplying the ink to an ink jet head.

The method according to the third aspect includes preparing a bottom lid with an ink outlet for supplying ink to the ink jet head. The bottom lid has one side designated to face inward when joined into the buffer tank. Then, a filter is attached to the bottom lid so as to cover the ink outlet from the side designated to face inward. Then, a top lid with an ink inflow port for receiving ink from the supply path is prepared. Then, at least the filter on the bottom lid is subjected to a process for enhancing hydrophilic properties. The bottom lid and top lid are joined to form the buffer tank, wherein the filter is located inside the buffer tank.

An ink jet recording apparatus according to a fourth aspect of the present invention includes an ink jet head, a buffer tank, an outflow port, and an ink inflow port. The ink jet head is for ejecting ink droplets. The buffer tank is for storing ink and supplying ink to the ink jet head. The buffer tank includes a bottom wall, a top wall, and a side wall. The bottom wall has an outer edge. The top wall is in confrontation with the bottom wall through a space for holding ink. The top wall has an outer edge. The side wall is connected to the outer edges of the bottom wall and the top wall. The outflow port is formed in the top wall and is for removing bubbles from the space. The ink inflow port is formed in the top wall of the buffer tank. The ink inflow port has a cylindrical shape and projects down towards the bottom wall. The ink inflow port has a bottom end nearest the bottom wall. The bottom end is formed with a notch that faces towards the outflow port.

An ink jet recording apparatus according to a fifth aspect of the present invention includes a head unit and a fluid introducing unit. The head unit includes a buffer tank and an ink jet head. The buffer tank is for storing ink and includes an ink outlet and an ink supply path. The ink supply path is for connecting to an ink supply source. The buffer tank is filled with a preservation fluid before the head is used. The ink jet head includes a plurality of ejection nozzles for ejecting ink that is supplied from the ink outlet onto a recording medium. The fluid introducing unit introduces the preservation fluid from the buffer tank into the ink jet head and expels the preservation fluid from the ejection nozzles to make the head unit ready for use.

An ink jet recording apparatus according to a sixth aspect of the present invention is for recording onto a recording medium and includes an ink supply source, a supply path, a buffer tank, an ink jet head, a top lid member, and a filter. The ink supply source supplies ink. The supply path is connected to the ink supply source. The buffer tank stores ink supplied from the ink supply source through the supply path. The ink jet head has a plurality of ejection nozzles from which ink supplied from the buffer tank is ejected onto the recording medium. The top lid member forms at least a top wall of the buffer tank. The top lid member is formed with an ink inflow port that is connected to the supply path. A bottom lid member forms a bottom wall of the buffer tank. The bottom lid member is formed with an ink outlet for supplying ink to the ink jet head. The filter is attached to the bottom lid and covers the ink outlet from inside the buffer tank. At least the filter has been subjected to a process for enhancing hydrophilic properties.

BRIEF DESCRIPTION OF THE DRAWINGS

In the Drawings:

FIG. 2(*b*) is perspective view showing an alternative example of the end of the ink introduction port;

FIG. 2(*c*) is perspective view showing an alternative example of the end of the ink introduction port;

DETAILED DESCRIPTION OF THE PREFERRED EMBODIMENTS

Figure 1:
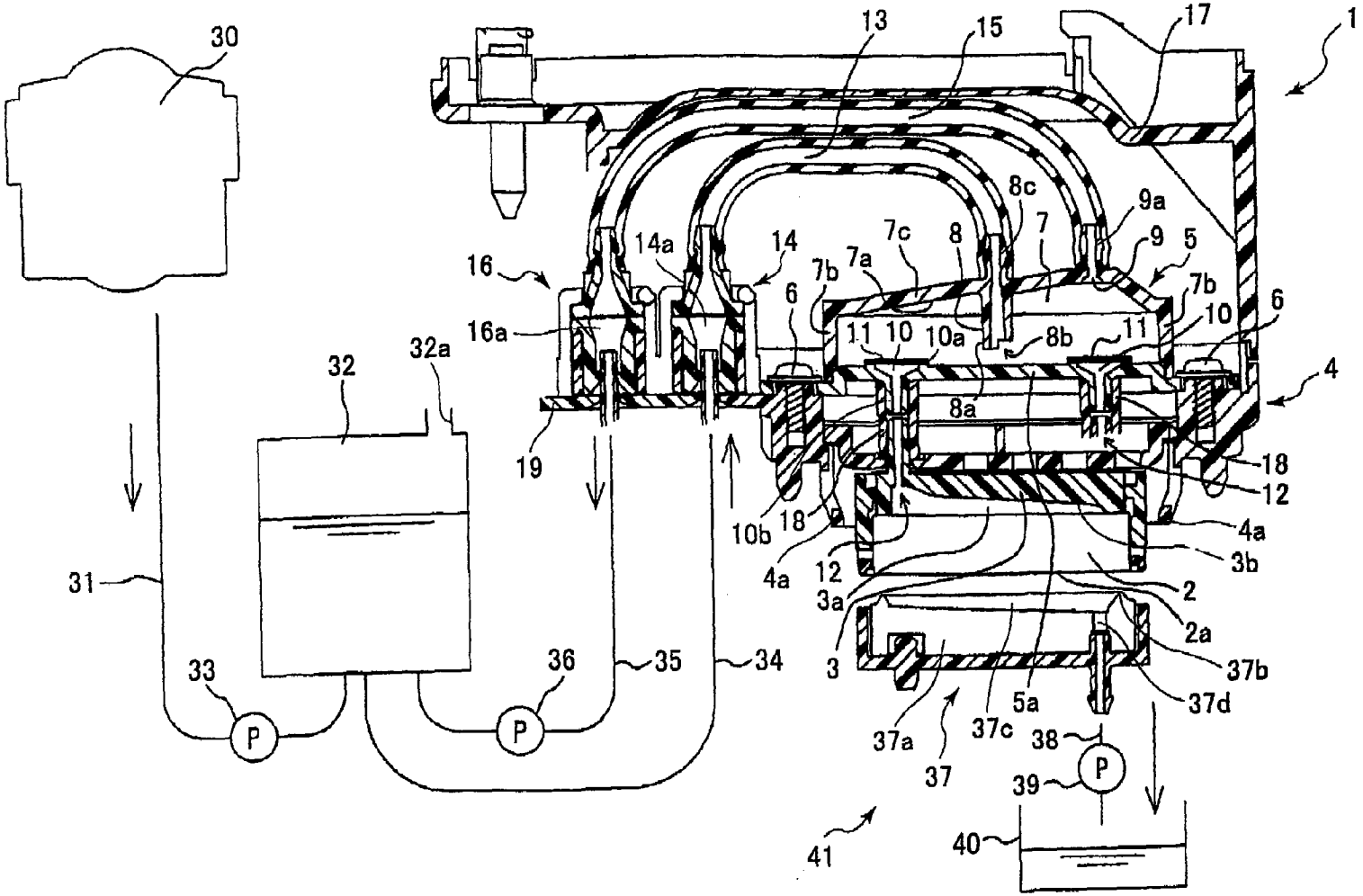
FIG. 1 is cross-sectional view showing an ink jet recording apparatus according to an embodiment of the present invention.
Figure 2A:
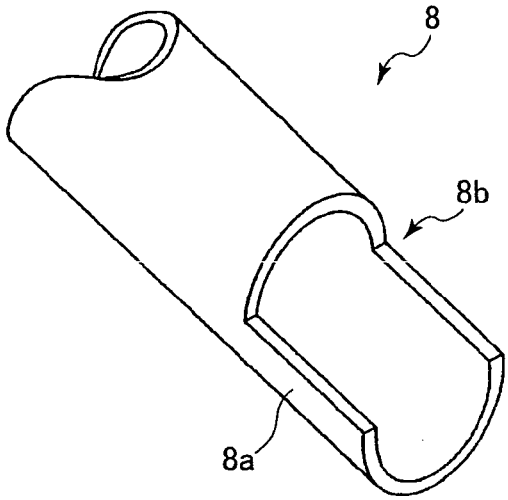
FIG. 2(*a*) is a perspective view showing the end of an ink introduction port of the ink jet recording apparatus of FIG. 1.
Figure 2B:
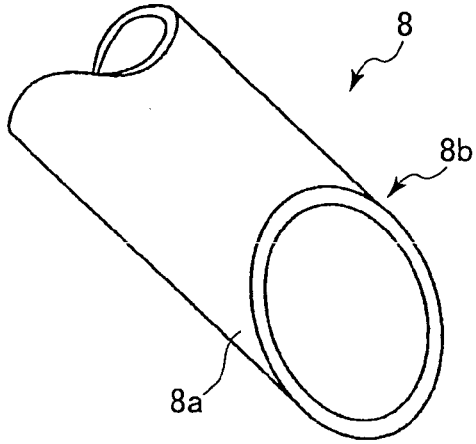
Figure 2C:
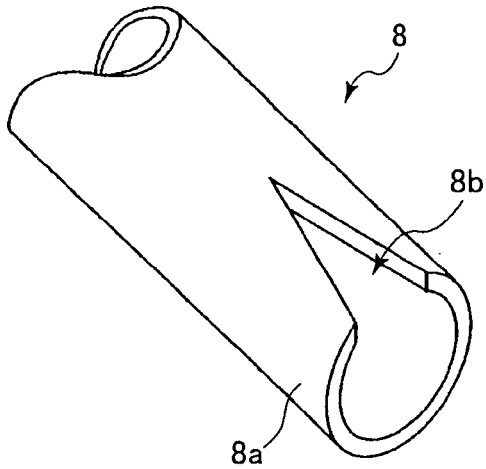

An ink jet recording apparatus according to a preferred embodiment of the present invention will be described with reference to the accompanying drawings. Firstly, the configuration of ink paths in an ink jet recording apparatus that is a preferred embodiment of the present invention will be described with reference to FIGS. 1 and 2(*a*). FIG. 1 is a schematic diagram of the ink paths in the ink jet recording apparatus. FIG. 2(*a*) is a perspective view of the end of an ink introduction port 8.

As shown in FIG. 1, a head unit 1 that can be inserted into and removed from the ink jet recording apparatus includes an ink jet head 2, a manifold 3, a buffer tank 5, tubes 13 and 15, and connectors 14 and 16. The ink jet head 2, the manifold 3, and the buffer tank 5 are fixedly mounted on a head holder 4 by screws 6. Also, the connectors 14, 16 are provided on a base extending horizontally from the head holder 4. The upper parts of connectors 14, 16 are connected to the upper part of the buffer tank 5 by the flexible tubes 13 and 15 respectively. A cover 17 is installed on the upper part of the head holder 4 and covers the buffer tank 5 and the tubes 13, 15, as the external wall of the head unit 1.

The structure of the ink jet head 2 has a well-known configuration such as that disclosed in Japanese Patent Application Publication No. 2001-260388. The inside of the ink jet head 2 contains a plurality of ink channels (not shown). The surface containing the ejection openings 2*a* contain a plurality of ejection nozzles (not shown) arranged in two rows and each in fluid communication with the respective ink channels. As is well known, each ejection channel is provided with a piezoelectric actuator (not shown). The piezoelectric actuator is energized to eject ink drops from each ejection nozzle.

The manifold unit 3 is fixed to the top of the ink jet head 2 by adhesive and contains two manifold chambers 3*a* that are connected to each row of ink channels. An introduction tube 12 projects from the top of each manifold chamber 3*a* (FIG. 1 shows only one tube 12). Each introduction tube 12 is connected to a connecting tube 10*b* through a connecting tube 18. The connecting tube 10*b* defines an ink outlet 10 in a bottom wall 5*a* of the buffer tank 5 to be described later. Each manifold chamber 3*a* has a ceiling 3*b*, which is the surface that is in confrontation with the upper end of the ink channels. Each ceiling 3*b* drops down from a position near the introduction tube 12. This reduces the cross-sectional area of the manifold chamber 3*a*.

The buffer tank 5 includes a case 7 made from synthetic resin with an opening in the bottom and a bottom wall 5*a* made from synthetic resin that covers and closes the opening in the case 7. The bottom wall 5*a* is substantially flat. The ink introduction port 8 extends downward from a top wall 7*c* of the case 7 at approximately the center of the top wall 7*c* with respect to longitudinal direction. The ink introduction port 8 is for supplying ink to the buffer tank 5. An end 8*a* at the bottom of the ink introduction port 8 is located near the bottom wall 5*a*. Also, a cylindrical-shaped connector 8*c* is continuous with the ink introduction port 8 and projects upward from the top wall 7*c*. The tube 13 is connected to connector 8*c*.

Figure 3:
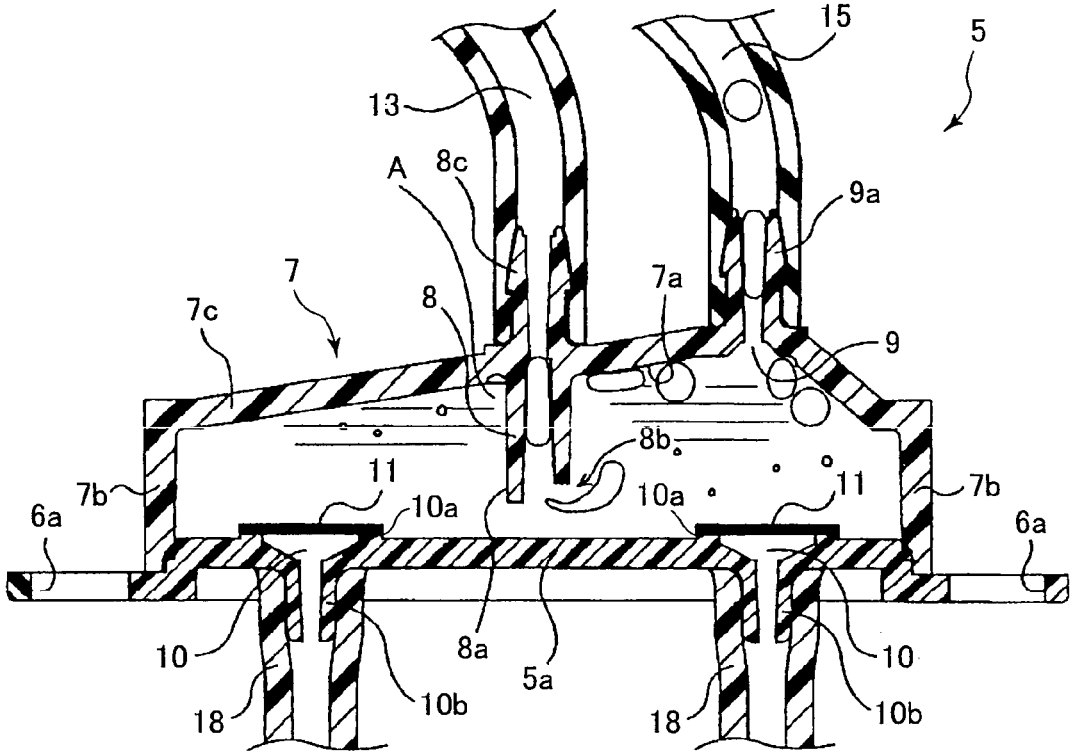
FIG. 3 is a cross-sectional view showing the flow of bubbles in a buffer tank of the ink jet recording apparatus of FIG. 1.

The end 8*a* of the ink introduction port 8 is shown in FIG. 2(*a*). As shown in FIG. 2(*a*), a notch 8*b* is formed in the side wall of the end 8*a*. The notch 8*b* is formed by cutting away an approximately semi-circular portion of the cylindrical wall of the ink introduction port 8 for a predetermined distance from the end. In this way, the ink supply path of the ink introduction port 8 is exposed to the side. As shown in FIG. 3, the notch 8*b* exposes the ink supply path in the same direction as from the ink introduction port 8 to an outflow port 9, that is, as the direction from the left-hand end of 7*c* to the right-hand end of the top wall 7*c* as per the view in FIG. 3. The notch 8*b* is always positioned below the level of the ink in the buffer tank 5. Note that the notch 8*b* can be provided in other shapes than shown in FIG. 2(*a*). For example, as shown in FIG. 2(*b*), the end 8*a* of the ink introduction port 8 may be cut at an inclined angle and, as shown in FIG. 2(*c*), the notch may be cut as a triangular notch.

Figure 4:
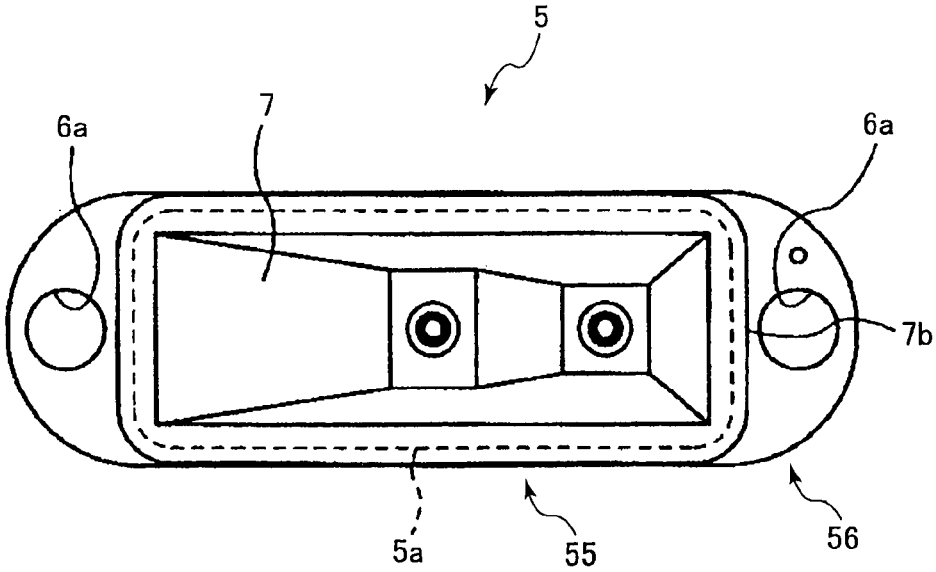
FIG. 4 is a plan view showing the buffer tank of FIG. 3.
Figure 5:
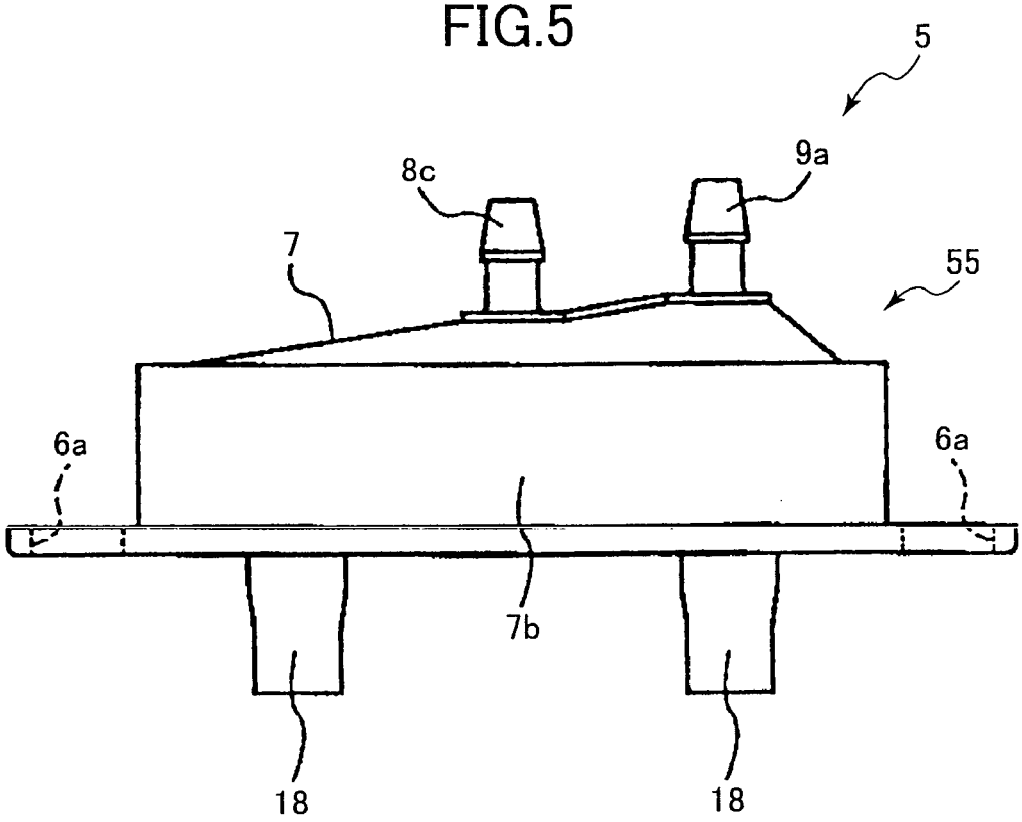
FIG. 5 is a side view showing the buffer tank of FIG. 3.

As shown in FIG. 4, the bottom wall 5*a* has an approximately rectangular shape in plan view and installation arms with holes 6*a* are provided at both ends of the bottom wall 5*a*. The screws 6 are inserted into the holes 6*a*. The upper wall 7*c*, the side wall 7*b*, and the bottom wall 5*a* enclose a space that serves to hold ink. Also, the outflow port 9 for removing ink and bubbles is opened near one end of the internal surface 7*a* of the top wall 7*c*. A cylindrical-shaped connector 9*a* projects upwards from the top wall 7*c* and defines the outflow port 9. The tube 15 is connected to the connector 9*a*. As shown in FIG. 5, the case 7 is formed with a gentle slant in the longitudinal direction from near one end to near the other end, where the peak is located. As shown in FIG. 3, the internal surface 7*a* of the top wall 7*c* also follows the same shape. The angle of inclination of this sloping surface is greater than the tilt angle tolerable by the recording apparatus when the recording apparatus is placed on a table (not shown) or other surface. Therefore, when the main body of the recording apparatus is placed so that the tilt angle is less than tolerance tilt angle, then the outflow port 9 is still the highest point of the internal surface 7*a* of the top wall 7*c*. The inclined surface of the internal surface 7*a* should have a tilt angle in the range from 5 to 15 degrees, and preferably around 10 degrees.

Figure 6:
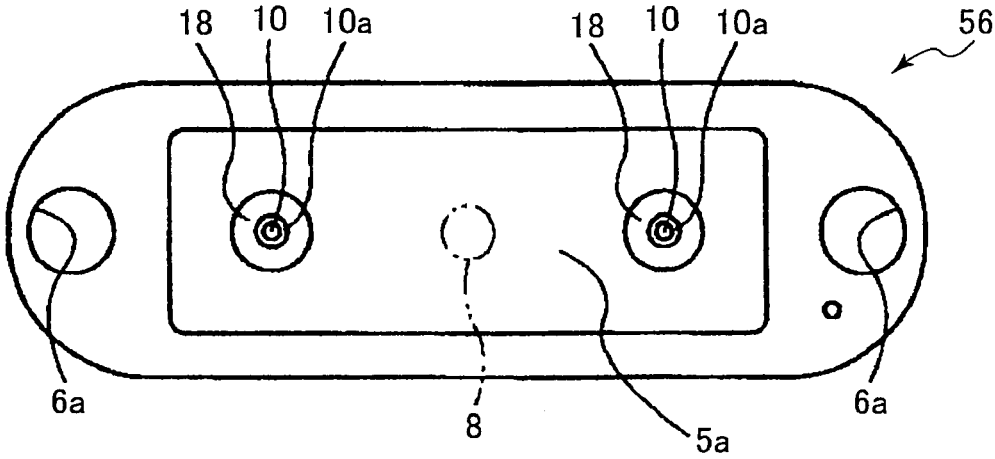
FIG. 6 is a view showing the bottom of the buffer tank of FIG. 3.
Figure 7:
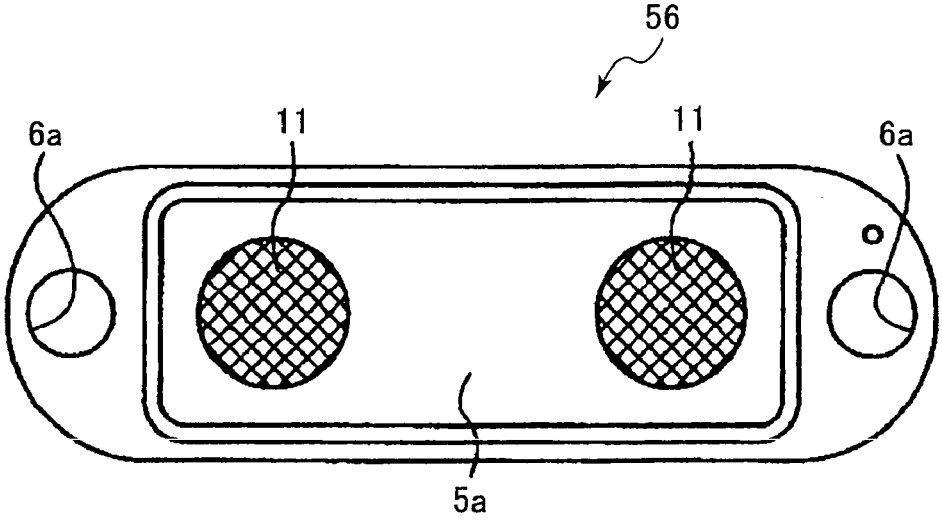
FIG. 7 is a plan view showing a bottom lid of the buffer tank 5 of FIG. 3.

Also, as shown in FIG. 1, the side wall 7*b* extends almost straight downward from the outer rim of the internal surface 7*a* of the top wall 7*c*. The inner rim at the lower end of the side wall 7*b* fits precisely with the bottom wall 5*a*. The bottom wall 5*a* is an almost flat plate. The side wall 7*b* rises at a right angle from the outer rim of the bottom wall 5*a*. As shown in FIG. 6, two ink outlets 10 that correspond with the two introduction tubes 12 of the manifold 3 are provided in the bottom wall 5*a* of a bottom lid 56. Each ink outlet 10 is defined by the downward-projecting cylindrical-shaped projections 10*b* and connects to a according one of the two manifolds 3 and the ink jet head 2. Also, each ink outlet 10 has a projection 10*a* that projects into the top surface of the bottom wall 5*a* (the inside of the buffer tank 5). As shown in FIG. 7, circular filters 11 for covering the ink outlets 10 are fixed to the top surface of the projection 10*a* by thermal welding that melts a part of the projection 10*a*. The filter 11 removes bubbles and foreign matter from the ink supplied to the ink jet head 2 from the buffer tank 5. The bottom wall 5*a* is a flat plate in order to simplify the thermal welding of the filter 11.

Also, the filter 11 is joined to each ink outlet 10 in the bottom wall 5*a* from the inside of the buffer tank 5. The filter 11 is a micron-range sintered metal fiber filter in sheet form. The fibers are intertwined in a complex manner to form a 3-D structure. The filter 11 has high porosity, so the filtering resistance is low. The mesh size is approximately 8 μm. Any bubbles or foreign matter mixed with the ink in the buffer tank 5 are caught on the surface or interior of the filter 11 and so will not flow into the manifold chamber 3*a*.

As shown in FIG. 1, the flexible tube 13 is connected at one end to the ink introduction port 8 on the buffer tank 5 and at the other end to the connector 14 provided on a carriage base 19 on the carriage. The flexible tube 13 forms part of the first in path 34. Also, the flexible tube 15 is connected at one end to the outflow port 9 on the buffer tank 5 and at the other end to the connector 16 provided on the carriage base 19. The flexible tube 15 forms part of the second ink path 35. The buffer tank 5, the flexible tube 13, and the flexible tube 15 are covered and protected by the cover 17 mounted on the carriage.

The ink supply source includes an ink cartridge 30 and a sub-tank 32. The ink cartridge 30 is connected to the bottom of the sub-tank 32 through a flexible tube 31. Ink in the ink cartridge 30 is supplied to the sub-tank 32 by the operation of a supply pump 33. So that ink from the sub-tank 32 can be supplied to the ink introduction port 8 of the buffer tank 5. The bottom of the sub-tank 32 is removably connected to the connector 14 through the first ink path 34, which is made from a flexible tube in order. Also, in order to be able to re-cycle ink from the outflow port 9 of the buffer tank 5 to the sub-tank 32, the second ink supply path 35, which is made from a flexible tube, is removably connected to the connector 16. A circulation pump 36 is provided along the second ink path 35. The top of the sub-tank 32 contains an opening 32*a* to atmosphere. Ink recycled from the buffer tank 5 is decelerated when it enters the sub-tank 32 in a manner that is similar to that disclosed in U.S. Pat. No. 6,257,712. Therefore, any bubbles mixed in the ink from the buffer tank 5, or any bubbles mixed in the ink supplied from the ink tank 30, separate from the ink and are released to atmosphere.

Both the ink cartridge 30 and the sub-tank 32 are separate from the head unit 1 and located in a stationary position away from the carriage. The level of the ink in the sub-tank 32 is lower than that of the surface containing the ejection openings 2*a* on the ink jet head 2. Therefore, during recording operations with the circulation pump 36 turned off, there is negative pressure acting on the surface containing the ejection openings 2*a*.

The carriage is mounted with components that configure the ink path from the ink jet head to the connectors 14 and 16. Although not shown in the drawings, a mechanism is provided for moving the carriage to a recording position and a purge position. In the recording position, the ejection openings 2*a* of the ink jet head 2 confront the printing surface of the recording medium. In the purge position the ejection openings 2*a* confront a suction cap 37. Also, a purge device 41 includes the suction cap 37, a unit (not shown) for raising and lowering the suction cap 37, a suction pump 39, and a drain tank 40. The suction cap 37 is disposed in confrontation with the ink jet head when the ink jet head is in the purge position. The unit for raising and lowering the suction cap 37 is for bringing a rubber member 37*a* on the suction cap 37 into contact with the surface containing the ejection openings 2*a* of the ink jet head 2. The suction pump 39 is for sucking ink from the suction cap 37 to the drain tank 40 through a suction pipe 38 connected to the suction cap 37. During purge operations, the suction cap 37 is brought close to and connected to the surface containing the ejection openings 2*a* of the ink jet head 2 so as to cover the ejection nozzles, using a commonly-known actuation method. Then ink is drained to the drain tank 40 through the suction pipe 38 by the operation of the suction pump 39.

Sometimes the ink jet head 2 needs to be filled up with ink. For example, this operation is carried out before the first time the ink jet head 2 is used after delivery, or after the ink cartridge 30 is replaced. Firstly, the supply pump 33 is activated and ink is supplied from the ink cartridge 30 to the sub-tank 32, so that there is a predetermined amount of ink in the sub-tank. Next, while the suction cup 37 covers the surface containing the ejection openings 2*a* of the ink jet head 2, the circulation pump 36 is activated to generate a negative pressure in the ink jet head 2. Then ink is supplied to the buffer tank 5 from the sub-tank 32 through the first ink path 34, the connector 14, the tube 13, and the ink introduction port 8. Activating the suction pump 39 develops negative pressure in the ink jet head 2 so that ink from the buffer tank 5 fills the ink channels through the ink outlet 10, the introduction tube 12, and the manifold chamber 3*a*.

The circulation pump 36 is turned off while ink drops are being ejected from the ink jet head 2 during recording operations. The ink in the buffer tank 5 decreases because ink is ejected from the ink jet head 2. When the ink level decreases, the pressure inside the buffer tank 5 drops and ink is supplied from the sub-tank 32 through the first ink path 34. When the circulation pump 36 is turned off, the second ink path 35 is closed. Ink is stored in the buffer tank 5 so that the end of the ink introduction port 8 is always below the level of the surface of the ink, so air will not become drawn in with ink flowing into the buffer tank 5. Generation of bubbles is kept to a very low level.

The first ink path 34 and the tube 13 are made from flexible resin tube that is resistant to corrosion by ink. However, with the passage of time, air can permeate through the walls of the tubes and dissolves in the ink flowing in the tubes. This increases the amount of air in the ink. When the ink becomes saturated with air, air that cannot dissolve in the ink forms bubbles. These bubbles flow into the buffer tank 5 through the ink introduction port 8 together with the ink.

As shown in FIG. 3, bubbles that flow into the buffer tank 5 together with ink are released into the buffer tank 5 from the end 8*a* of the ink introduction port 8 near the bottom wall 5*a*. At this time the bubbles flow in the downward direction (towards the end 8*a*) due to the flow of ink until they reach the notch 8*b* provided in the end 8*a* of the ink introduction port 8. When the bubbles reach the notch 8*b*, they are released into the buffer tank 5 without reaching the end 8*a* of the ink introduction port 8 due to their buoyancy force, which acts in the opposite direction to the direction of flow of the ink. As stated previously, the opening of the notch 8*b* is facing towards the outflow port 9, so that bubbles are released from the ink introduction port 8 towards the outflow port 9.

Because of this, bubbles released into the buffer tank 5 rise up along the outside of the wall of the ink introduction port 8 that faces towards the outflow port 9 and accumulate at the internal surface 7*a* of the top wall 7*c*. Furthermore, the bubbles continue rising along the internal surface 7*a* of the top wall 7*c*, which is formed at a slope, and accumulate at the highest point of the buffer tank, namely near the outflow port 9. Furthermore, some bubbles are suspended in the ink or cling to the inner surfaces of the buffer tank or on the filter 11. Therefore, periodically the circulation pump 36 is activated for a predetermined time to carry out a circulation purge.

In other words, ink is made to circulate along the circulation route from the sub-tank 32, the first ink path 34, the buffer tank 5, the second ink path 35, and the sub-tank 32. In this way, bubbles are re-cycled together with the ink from the buffer tank 5 to the sub-tank 32. The flow velocity of the ink entering the sub-tank 32 drops, and the bubbles separate from the ink due to the buoyancy of the bubbles. The air is released through the opening 32*a* to the atmosphere. In this way, it is possible to effectively expel the bubbles generated during recording operations.

During this circulation purge, the surface containing the ejection openings 2*a* of the ink jet head 2 is covered and sealed by the suction cap 37, but the suction pump 39 is not activated. Because of this, there is a closed system between the sub-tank 32 and the buffer tank 5 with only one opening 32*a* to the atmosphere. Therefore, a flow can be generated with flow velocity that is sufficiently high to transport the bubbles accumulated near the outflow port 9 to the sub-tank 32. If ink channels or the ejection openings in the ink jet head 2 become blocked because of dried ink or for some other reason, that blockage can be removed by covering the surface containing the ejection openings 2*a* of the ink jet head 2 with the suction cap 37 and carrying out a suction purge using the suction pump 39.

The internal surface 7*a* of the top wall 7*c* of the buffer tank 5 has a slant, and the outflow port 9 is provided at the highest point of the internal surface 7*a*. Therefore, when carrying out the circulation purge as described above with the buffer tank 5 filled with ink, bubbles will be lead by the sloping surface to the outflow port at the highest point, and will be effectively brought to the sub-tank 32 through the second ink path 35 and removed.

Also, after removing the bubbles from the buffer tank 5 by the circulation purge, even if the commonly-known suction purge is carried out on the ink jet head 2 by activating the suction pump 39, bubbles from the buffer tank 5 will not be drawn into the ink jet head 2 and block the ejection nozzles. In other words, because bubbles exit the bottom of the ink introduction port 8 only in the direction toward the outflow port 9, bubbles do not accumulate in the corner area A formed by the ink introduction port 8 and the internal surface 7*a* of the top wall 7*c*. If the bubbles accumulated in corner area A, the bubbles would be prevented from being removed in the circulation purge described above. Therefore, when a suction purge is carried out bubbles are not drawn into the ink jet head 2 and defective ejection in the ink jet head will occur less frequency.

During the manufacturing process of the ink jet recording apparatus described above, the ink jet head 2, the manifold 3, and the buffer tank 5 are assembled into one unit in the head holder 4. In this condition, cleaning fluid is introduced at high pressure through the ink introduction port 8, and any foreign matter remaining in the unit is removed together with the cleaning fluid through the ejection openings 2*a* of the ink jet head 2 and the outflow port 9 of the buffer tank 5. When adding the cleaning fluid, the orientation of the head unit 1 can be either the upright position as when the ink drops are being ejected from the ink jet head 2 during recording operations, or the reverse orientation. The cleaning fluid is either water or a preservation fluid 45 that fills the ink jet head during shipment. Subsequently, high pressure air is introduced through the ink introduction port 8 to remove any remaining cleaning fluid. Therefore, it is not necessary to provide any special configuration for removing cleaning fluid, thereby allowing low cost manufacture.

Figure 8:
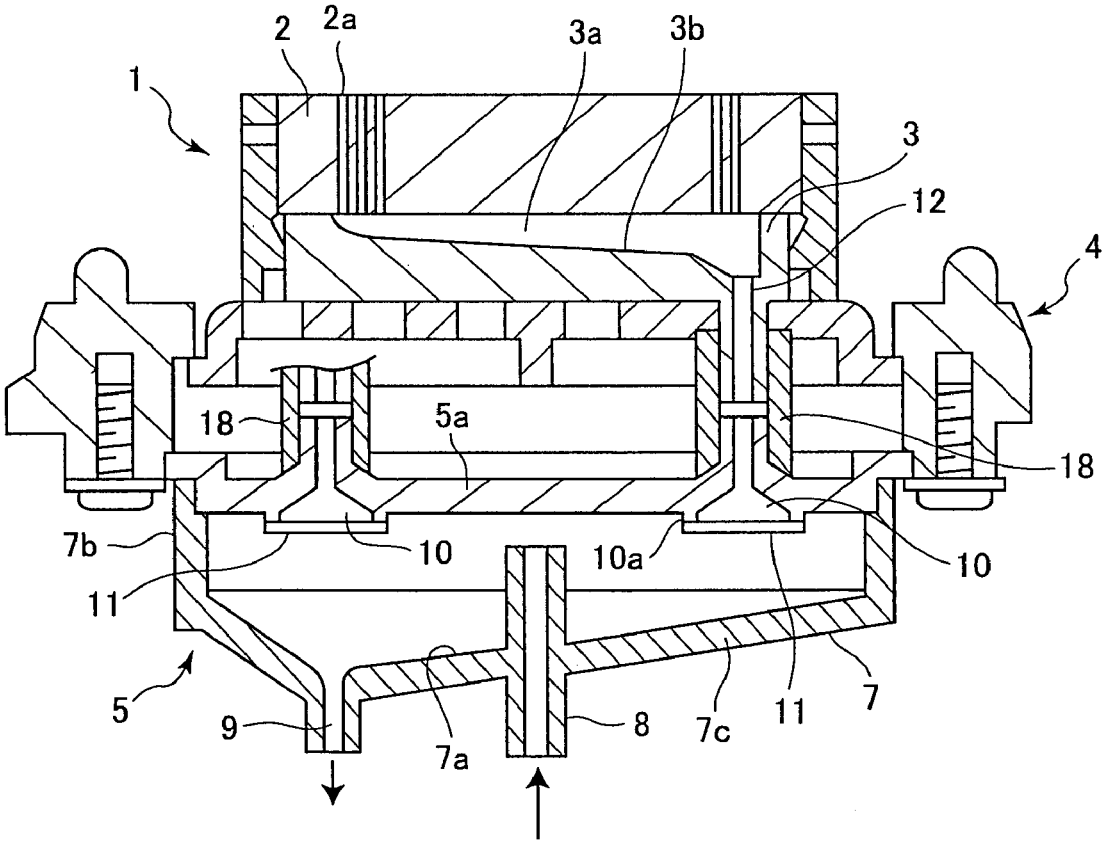
FIG. 8 is a cross-sectional view showing removal of the cleaning fluid during the manufacturing process of the ink jet recording apparatus of FIG. 1.

When removing cleaning fluid, the head unit 1 is placed upside down as shown in FIG. 8. In this condition, the outflow port 9 is the lowest point of the buffer tank 5. Also, the internal surface 7*a* of the top wall 7*c* slopes downwards towards the outflow port 9 and the side wall 7*b* forms an obtuse angle with the internal surface 7*a* of the top wall 7*c*. Therefore, when high pressure air is introduced into the ink introduction port 8, most of the air flows, because of the resistance of the filters 11, in the direction from the bottom wall 5*a*, the side wall 7*c*, and the internal surface 7*a*. Gravity is also acting in addition to the flow of air. Therefore, the cleaning fluid does not remain in the corner between the bottom wall 5*a* and the side wall 7*b* or the corner between the side wall 7*b* and the internal surface 7*a* of the top wall 7*c*. The cleaning fluid is forced to flow along the internal surface 7*a* of the top wall 7*c* and out through the outflow port 9. By placing the unit upside down in this manner, there is no obstacle to the flow of cleaning fluid and there are no corners where the flow can stagnate. Therefore the remaining cleaning fluid can be effectively removed.

It should be noted that inverting the head unit 1, which includes the ink jet head 2, the manifold 3, and the buffer tank 5 as an integrated unit, it is possible to completely remove any remaining cleaning fluid through the outflow port 9 and the ejection channels using gravity in addition to or instead of air pressure.

As shown in FIGS. 3 and 4, a corner A is formed between the internal surface 7*a* of the top wall 7*c* and the ink introduction port 8 at the position on the opposite side to the outflow port 9. The corner A has a very narrow width in the direction orthogonal to the plane of the sheet on which is FIG. 3 drawn. Also, as shown in FIG. 3, the widthwise ends of the corner A are separated from the side walls 7*b* that extend in the direction parallel to the sheet on which FIG. 3 is shown. Therefore, the corner A forms no obstacle to the cleaning fluid flowing down the internal surface 7*a* of the top wall 7*c*. It is clear that removal of cleaning fluid can be carried out using gravity alone, without the use or air flow.

If removal of cleaning fluid were attempted with the unit in the upright condition as for printing operations, then cleaning fluid would be blown by the air flow into the corners between the bottom wall 5*a* and the side wall 7*b* and between the bottom wall 5*a* and the projection 10*a*. This cleaning fluid could not be removed through the ink outlet 10 or the outflow port 9. This remaining cleaning fluid would create bubbles and films in the ink jet head 2 and the manifold 3 during transport, which would cause blockage of the ejection channels of the ink jet head 2 as described above.

Part of the air introduced into the ink introduction port 8 will pass through the filter 11 and flow through the manifold and the ink jet head. Any cleaning fluid in the manifold 3 or the ink jet head 2 will be expelled through the ejection nozzles.

Figure 9:
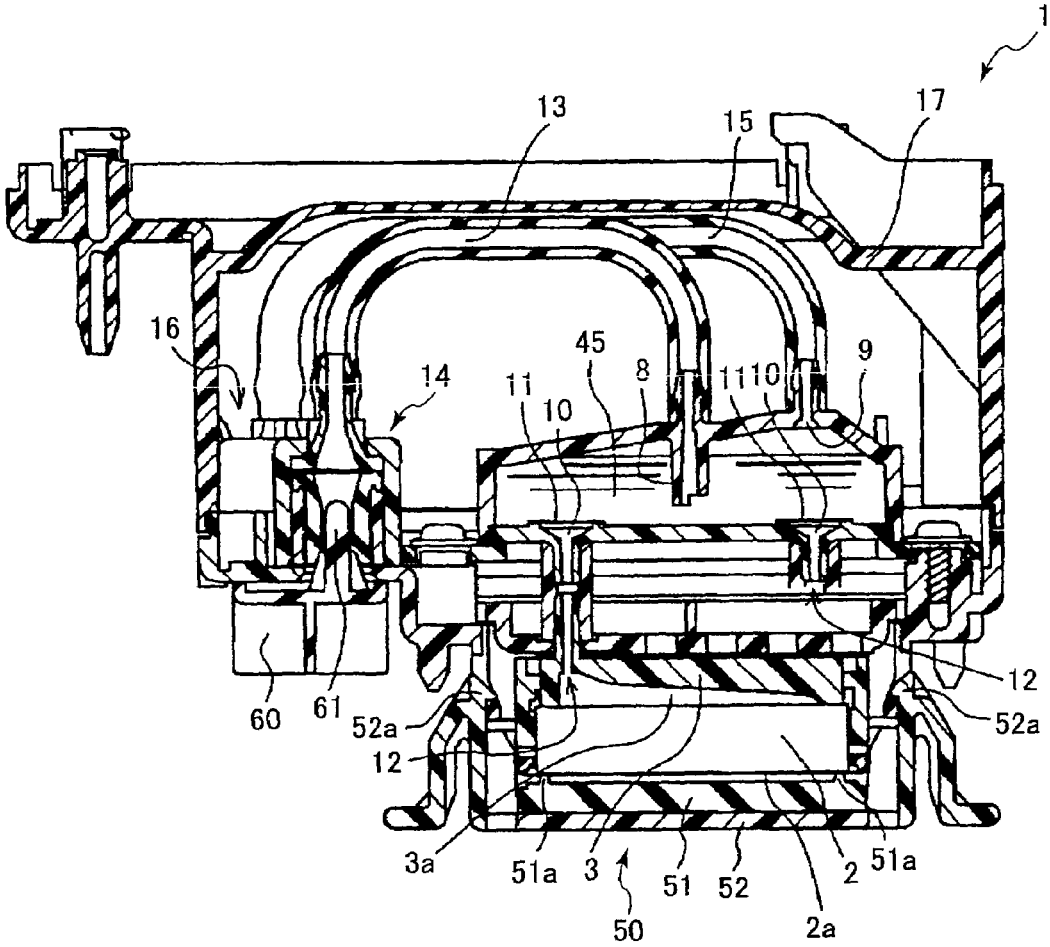
FIG. 9 is a cross-sectional view showing the head unit during shipment.

Next, the condition during shipment of the ink jet recording apparatus and the operation of first introducing ink to the ink jet head 2 will be explained with reference to FIGS. 1 and 9. FIG. 9 is a sectional view showing the condition of the head unit during shipment.

According to the present embodiment, the head unit 1 is not shipped mounted in the ink jet recording apparatus. The head unit 1 is shipped separately from the ink jet recording apparatus. As shown in FIG. 9, during shipment the buffer tank 5 of the head unit 1 is filled with preservation fluid 45.

The preservation fluid 45 has the same composition as ink but without coloring agents such as pigments and dyes. The preservation fluid 45 includes water, surface active agent, drying preventive agent, pH adjustment agent, corrosion prevention agent, anti-mold agent. The surface active agent weakens the surface tension of the preservation fluid 45 and increases the wettability, so that the preservation fluid penetrates to every corner when the preservation fluid 45 is first introduced into the ink jet head 2. Also, a sufficient amount of surface active agent is added so that the viscosity of the preservation fluid 45 is lower than that of ink that contains coloring agents. Also, the preservation fluid 45 has a high affinity for ink, which has almost the same composition as the ink. Therefore, the preservation fluid 45 is used as an introduction fluid to introduce the ink into the fine flow paths in the ink jet head 2. It is desirable that the volume of preservation fluid 45 should be approximately the same as the total volume of the ink jet head 2 and the manifold 3.

In order to prevent drying of the head unit 1 in which preservation fluid 45 has been introduced into the buffer tank 5, all openings that would otherwise be in fluid communication with atmosphere are capped. Such openings include the plurality of ejection nozzles (not shown) on the surface containing the ejection openings 2*a* of the ink jet head 2 and the connectors 14 and 16 for connecting with the sub-tank 32. The ejection nozzles on the surface containing the ejection openings 2*a* are closed with a cover 50 and the connectors 14 and 16 are closed with a cover 60.

The cover 50 includes a rubber member 51 and a resin stopper 52. The rubber member 51 is provided with a frame-shaped protrusion 51*a* that contacts the surface containing the ejection nozzles 2*a* so that the ejection nozzles (not shown) are enclosed. The rubber member 51 is supported on the outside by the box-shaped stopper 52. Hooks 52*a* provided on the rim of the stopper 52 engage with locking parts 4*a*, which are provided on the head holder 4 as shown in FIG. 1. In this way, the stopper 52 is fixed so that the rubber member 51 presses onto and covers the outer perimeter of the surface containing the ejection openings 2*a*. Also, the cover 60 covers openings 14*a* and 16*a* which, as shown in FIG. 1, are located in the connectors 14 and 16 that connect to the buffer tank 5 through the tubes 13 and 15. The cover 60 has two projections 61 (only one of them is shown in FIG. 9) that are inserted into the openings 14*a* and 16*a* to close off the buffer tank 5 from the outside air.

After the buffer tank 5 has been closed off from the external air, the preservation fluid 45 enclosed in the buffer tank 5 forms a meniscus on each opening of the filters 11. As stated previously, the wettability of the preservation fluid 45 is high, so if external pressure is applied then the meniscus can be easily broken. However, when the cover 60 is attached, insufficient pressure develops for the preservation fluid 45 to pass through the filters 11. Therefore, the preservation fluid 45 remains in the buffer tank 5 and does not seep through to the manifold 3 and the ink jet head 2, so the ink jet head remains in a dry condition, and blockage of the ejection nozzles is prevented. Also, the preservation fluid 45 is not connected to the outside air, so drying of the buffer tank 5 is prevented. In this way, the head unit 1 is shipped from the factory with preservation fluid 45 enclosed in the buffer tank 5.

After delivery of the ink jet recording apparatus and when carrying out the initial operation, or when carrying out the initial operation after replacing the head unit 1, the covers 50 and 60 are removed and the operation to fill the head unit with ink is carried out.

As indicated in FIG. 1, first, a purge operation is carried out when carrying out the ink filling operation. The rubber member 37*a* of the suction cap 37 is provided with a projection 37*b* that surrounds the ejection nozzles (not shown) of the surface containing the election openings 2*a* of the ink jet head 2. The projection 37*b* defines a suction chamber 37*c* when the suction cap 37 is brought into contact with the surface containing the ejection openings 2*a*. A suction opening 37*d* is provided at an end of the suction chamber 37*c*. The suction opening 37*d* is connected to the suction pump 39 through the suction pipe 38. When the suction pump 39 is activated, a negative pressure develops in the suction chamber 37*c* and the preservation fluid 45 is sucked from the buffer tank 5 into the inside of the ink jet head 2 and the manifold 3 through the introduction tubes 12 and the ink outlets 10. The preservation fluid 45 can pass through the filters 11 because of the suction force.

As stated previously, the preservation fluid 45 has a high wettability. Therefore, when the preservation fluid 45 is introduced into the manifold chambers 3*a* and the ink jet head 2, the preservation fluid spreads to all the corners of the internal walls of the manifold chambers 3*a* and ink jet head 2. From there the preservation fluid 45 permeates to the narrow ink channels (not shown on the drawings) and the ejection nozzles. Also, any air in the manifold 3 or ink jet head 2 is expelled so as to push out the preservation fluid 45, so no bubbles remain attached to the internal wall surfaces. The preservation fluid 45 is expelled to the drain tank 40.

Next, the suction pump 39 is turned off, the supply pump 33 is activated, and all the ink channels of the ink jet head 2 are filled with ink as described previously. At this time, the inside of the manifold chambers 3*a* and the ink channels, have a high affinity for ink because they have been wetted with the preservation fluid 45. Therefore, the ink fills all the corners of the manifold chambers 3*a* and the ink channels without creating bubbles.

Also, if the ink and the filter 11 have poor affinity, that is, if the filter 11 has poor wettability with respect to the ink, then bubbles will separate from the ink when ink is being supplied to the ink jet head 2 from the buffer tank 5 during printing. These bubbles will become attached to the surface or interior of the filter 11 and act as a nucleus around which other bubbles will accumulate. The purge operation described above cannot completely remove all the bubbles, so the remaining bubbles grow on the filter 11. This results defective ejecting during printing and other undesirable effects. Therefore, it is necessary to carry out plasma processing on the surface of the filter. The surface of the filter 11 is treated to clean the surface and improve hydrophilic properties, by placing the filter 11 in a plasma formed by applying a high voltage to a gas in a high vacuum. The wettability of the filter 11 by ink is improved by this process. In other words, the affinity of the filter 11 for ink is increased, and it becomes difficult for the bubbles to cling to the filter 11.

Also, bubbles clinging to the interior of the filter 11 are expelled together with ink by purge operations before the bubbles can grow to any significant size. Clogging of the filter 11 will be prevented and ink will be effectively provided to the ink jet head 1. One effect of the plasma treatment is that it is possible to make the flow resistance of the filter 11 to the passage of ink more uniform, so plasma processing is carried out on the filter 11 as a procedure for enhancing hydrophilic properties of the filter 11 during the manufacturing process of the buffer tank 5.

Next, a method of manufacturing the buffer tank 5 will be described. A top lid 55 and the bottom lid 56 that form the buffer tank 5 are made separately by, for example, injection molding. Then, as shown in FIG. 7, filters 11 are attached to the two ink outlets 10 formed in the top surface of the bottom lid 56 so as to cover the ink outlets 10. Filters 11 are fixed to the outer rims of ink outlets 10 using commonly-known methods such as thermal welding or ultrasonic welding. Next, the inner surface of the bottom lid 56 (the inner surface of the buffer tank 5) is subjected to plasma processing to improve the surface of the bottom wall 5*a* and the filters 11 attached to the bottom wall 5*a* using commonly-known plasma processing equipment. Then, the top lid 55 and the bottom lid 56 are connected by a method such as thermal welding or ultrasonic welding to form the buffer tank 5.

As explained above, the buffer tank 5, which supplies ink to the ink jet head 2, is supplied with ink from the sub-tank 32. Because bubbles mix with the ink in the ink distribution paths, a notch 8*b* is provided in the end 8*a* of the ink introduction port 8 through which ink is supplied to the buffer tank 5. The notch 8*b* on the ink introduction port 8 is oriented towards the outflow port 9 from which bubbles in the buffer tank 5 can be expelled. Therefore, bubbles that enter the buffer tank 5 together with the ink are led towards the outflow port 9. Furthermore, the internal surface 7*a* of the top wall 7*c* of the buffer tank 5 is formed with a slope, so bubbles float to the highest point within the buffer tank 5 near the outflow port 9. In this way, bubbles can be completely removed from the buffer tank 5 by discharge operations and bubbles are also prevented from being drawn into the ink jet head 2 during a purge operation. This eliminates one cause of defective ejection from the ink jet head 2.

Also, the head unit 1 is shipped without being fixed to the main body of the ink jet recording apparatus. The head unit 1 is shipped from the factory with the buffer tank 5 filled with preservation fluid 45 and with the covers 50 and 60 closing the paths to the outside air. The ink outlets 10 through which ink flows from the buffer tank 5 to the manifold chambers 3*a* are covered with the filters 11. As long as the head unit 1 is in a closed condition, the preservation liquid 45 will not flow through the filter 11, so the preservation fluid 45 cannot flow into the manifold chambers 3*a* and the ink jet head 2. Therefore, the manifold chambers 3*a* and the ink jet head 2 are maintained in a dry condition, and the preservation fluid 45 itself that is enclosed in the head unit 1 can be prevented from drying out.

Then, the head unit 1 is installed for the first time on the ink jet recording apparatus and an ink filling operation is carried out. First, a purge operation is carried out by which preservation fluid 45 is introduced into the manifold chambers 3*a* and the ink jet head 2. The preservation fluid 45, which has a high wettability, permeates throughout the manifold chambers 3*a* and the ink jet head 2, allowing no bubbles to remain. Subsequently, the manifold chambers 3*a* and the ink jet head 2 are filled with ink, and because the affinity of ink for the preservation fluid 45 is high, the interiors of the manifold chambers 3*a* and the ink jet head 2 are smoothly filled with ink.

The filters 11 attached to the buffer tank 5 of the ink jet recording apparatus have undergone plasma processing. This plasma processing is carried out on the bottom lid 56 that forms part of the buffer tank 5 after the filters 11 have been attached to the bottom lid 56. Therefore the side of the filters 11 facing the inside of the buffer tank 5 is reliably subjected to plasma processing. The wettability of the filter 11 with respect to ink is improved by being subjected to plasma processing so it is more difficult for bubbles to cling to the filters 11. Therefore, it is easier to expel bubbles that are clinging to the interior openings of the filters 11 together with ink by the purge operation. Occurrence of defective ejection due to growth of the bubbles is less likely to occur during printing.

Figure 10:
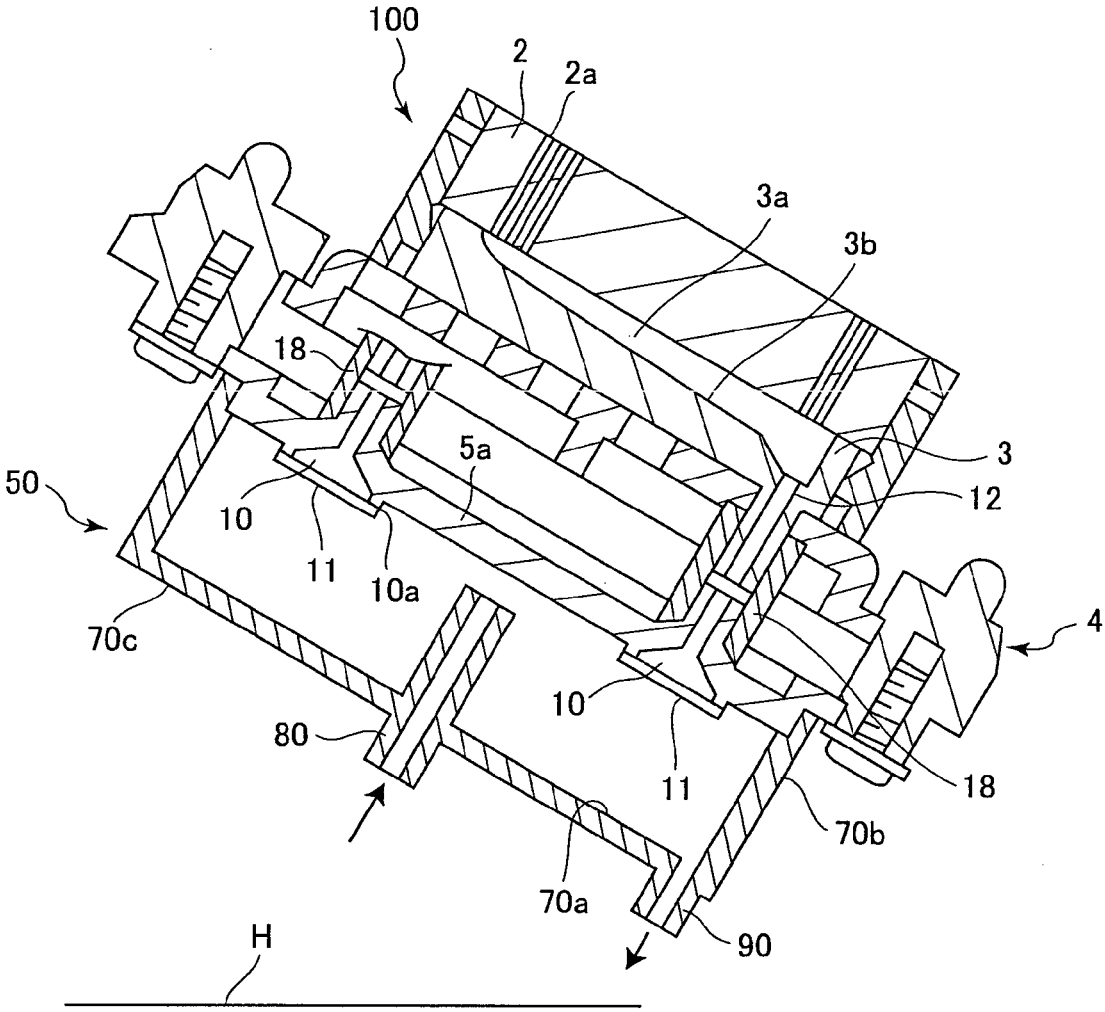
FIG. 10 is a cross-sectional view showing removal of the cleaning fluid during the manufacturing process of an ink jet recording apparatus according to another embodiment of the present invention.

FIG. 10 shows another preferred embodiment of the present invention. In this preferred embodiment an internal surface 70*a* of the top wall 70*c* is parallel to the bottom wall 5*a*. An outflow port 90 is opened in the corner that is between two intersecting side walls 70*b* and that is between the internal surface 70*a* of the top wall 70*c* and the side wall 70*b*. Only one of the two intersecting side walls 70*b* is shown in FIG. 10, that is, the right-hand side wall 70*b*. The other one of the intersecting side walls 70*b* extends in the direction in which the surface of the sheet on which FIG. 10 is drawn extends. Unlike the previous preferred embodiment, bubbles do not accumulate at the high point of the sloping internal surface 70*a* of the top wall 70*c* when in the position for printing operations. However, the function of returning the bubbles and ink to the sub-tank 32 by circulating the ink can be achieved.

In the same manner as the previous preferred embodiment, in order to remove the cleaning fluid after cleaning a head unit 100 with cleaning fluid, the head unit 100 is either inverted or turned at an oblique angle with respect to the horizontal plane H so that the outflow port 90 is the lowest point as shown in FIG. 10. In this orientation, the nearby internal surface 70*a* of the top wall 70*c* and the side wall 70*b* are in a slant that slopes down towards the outflow port 90. By introducing air into the ink introduction port 80, it is possible to remove the cleaning fluid in the buffer tank 5 through the outflow port 90 due to the air flow and gravitational force, as for the previous preferred embodiment. Also, it is possible to remove all cleaning fluid in the manifold 3 or in the ink jet head 2.

A commonly-known heat generating device can be used instead of a piezoelectric actuator in the ink jet head 2. The heat generating device locally boils the ink and causes the ink to be ejected due to the pressure. Also, it is possible to do away with the manifold 3 and directly connect the buffer tank 5 with the ink jet head 2 to supply ink to the ink channels. Also, the circulation pump 36 can be provided along the first ink path 34. In the embodiments, the head holder 4 moves with respect to the recording medium during printing. However, a mechanism for moving the support for the recording medium can be provided so that the recording medium moves relative to the ink jet head 2.

Many kinds of modifications can be made to the embodiments of the present invention. For example, the embodiments describe that during shipment, the volume of preservation fluid in the buffer tank 5 is approximately equal to the internal volume of the manifold 3 and the ink jet head 2. However, the volume of preservation fluid 45 can be greater than this volume as long as there is sufficient preservation fluid 45 to fill the ink channels and the manifold 3 when first carrying out a purge operation on the head unit 1. The cover 60 may be a gas impermeable adhesive tape that is fixed to the surface around the openings 14*a*, 16*a* of the connectors 14, 16 using thermal welding.

Also, embodiments describe that plasma processing is carried out on the bottom lid 56 to which the filters 11 have been fixed. However, the plasma processing can be carried out on just the filters 11. Also, instead of plasma processing, commonly-known ion processing can also be carried out.

What is claimed is:

1. A head unit cleaning method for cleaning a head unit including: an ink jet head having a plurality of ink channels, the ink jet head ejecting ink while the head unit is in a printing posture; a buffer tank for storing ink to be supplied to the ink jet head, the buffer tank having a top wall formed with a first port and a second port; and a manifold disposed between and connected to the ink jet head and the buffer tank, the manifold distributing ink from the buffer tank to the plurality of ink channels in the ink jet head, the cleaning method comprising:

introducing cleaning fluid into the buffer tank through the first port to remove foreign matter from the head unit through the second port;

turning the head unit upside down with respect to the printing posture so that the second port is located in a lowermost position and the top wall slants down toward the second port; and removing the cleaning fluid remaining in the head unit through the second port.

2. The head unit cleaning method according to claim 1, wherein the step of introducing the cleaning fluid includes maintaining the head unit in at least one of the printing posture and upside down with respect to the printing posture while introducing the cleaning fluid.

3. The head unit cleaning method according to claim 1, wherein the step of introducing the cleaning fluid includes applying a positive pressure to the cleaning fluid to introduce the cleaning fluid into the buffer tank through the first port.

4. The head unit cleaning method according to claim 1, wherein the step of removing the cleaning fluid includes introducing air into the buffer tank through the first port at a pressure greater than atmospheric pressure.

5. The head unit cleaning method according to claim 4, wherein the buffer tank further includes a bottom wall formed with a third port communicating with the manifold, and a filter attached to a projected inner surface of the bottom wall to cover the third port, and in the cleaning fluid removing step the filter hinders the air introduced into the buffer tank from passing therethrough.

6. The head unit cleaning method according to claim 1, wherein while the head unit is in the printing posture, the ink jet head ejects ink that includes a fluid and a coloring agent, and the cleaning fluid has the same composition as the fluid of the ink without the coloring agent.

7. The head unit cleaning method according to claim 1, wherein the first port is for supplying ink from an ink supply source into the buffer tank and the second port is for discharging air bubbles separated from ink in the buffer tank while the head unit is in the printing posture.

8. The head unit cleaning method according to claim 1, wherein the buffer tank of the head unit further includes a bottom wall that is substantially flat, and side walls that rise up from outer edges of the bottom wall, and the top wall is slanting and in confrontation with the bottom wall, the cleaning fluid flowing down from the bottom wall, along the slanting top wall, to the second port in the cleaning fluid removing step.

9. A method of introducing ink into an unused head unit including: a buffer tank for storing ink, the buffer tank having an ink outlet and an ink supply path, the ink supply path being for connecting to an ink supply source; and an ink jet head having a plurality of ejection nozzles through which ink supplied from the ink outlet is ejected onto a recording medium, the ink introducing method comprising:

maintaining the buffer tank filled with a preservation fluid before the head unit is used;

introducing the preservation fluid from the buffer tank into the ink jet head before introducing ink into the head unit;

expelling the preservation fluid from the ink jet head; and introducing ink from the ink supply source into the ink jet head through the buffer tank.

10. An ink jet recording apparatus, comprising:

an ink jet head for ejecting ink droplets;

a buffer tank for storing ink and supplying ink to the ink jet head, the buffer tank including a bottom wall, a top wall, and a side wall, the bottom wall having an outer edge, the top wall being in confrontation with the bottom wall through a space for holding ink, the top wall having an outer edge, and the side wall being connected to the outer edges of the bottom wall and the top wall;

an outflow port formed in the top wall, the outflow port being for removing bubbles from the space; and an ink inflow port formed in the top wall of the buffer tank, the ink inflow port having a cylindrical shape and projecting down towards the bottom wall, the ink inflow port having a bottom end nearest the bottom wall, the bottom end being formed with a notch that faces towards the outflow port.

11. The ink jet recording apparatus according to claim 10, wherein the notch of the ink inflow port is submerged in the ink in the buffer tank.

12. The ink jet apparatus according to claim 10, wherein the outflow port is located in a highest position of the top wall of the buffer tank while the ink jet head is in a printing posture for ejecting ink droplets.

13. An ink jet recording apparatus comprising:

a head unit including:

a buffer tank for storing ink including an ink outlet and an ink supply path, the ink supply path being for connecting to an ink supply source, the buffer tank being filled with a preservation fluid before the head unit is used; and an ink jet head including a plurality of ejection nozzles for ejecting ink that is supplied from the ink outlet onto a recording medium; and a fluid introducing unit that introduces the preservation fluid from the buffer tank into the ink jet head and expels the preservation fluid from the ejection nozzles to make the head unit ready for use.

14. The ink jet recording apparatus according to claim 13, wherein the preservation fluid includes a surface active agent.

15. The ink jet recording apparatus according to claim 13, wherein the ink supply source supplies ink that includes a fluid and a coloring agent, the preservation fluid having the same composition as the fluid of the ink without the coloring agent.

16. The ink jet recording apparatus according to claim 13, wherein the buffer tank further includes a filter located in the ink outlet, the filter having a mesh size small enough to prohibit the preservation fluid in the buffer tank from passing through the filter while the supply path is in a sealed condition.

17. The ink jet recording apparatus according to claim 13, wherein the ink supply path of the buffer tank has an open end for connecting to the ink supply source, the ink jet head further includes a cover that seals the plurality of nozzles and the buffer tank further includes a cover that seals the open end of the ink supply path.

* * * * *